US006971455B2

(12) United States Patent
Shibata et al.

(10) Patent No.: US 6,971,455 B2
(45) Date of Patent: Dec. 6, 2005

(54) HAMMER DRILL WITH A MECHANISM FOR PREVENTING INADVERTENT HAMMER BLOWS

(75) Inventors: Mitsuyoshi Shibata, Nishio (JP); Masanori Furusawa, Kariya (JP); Yasuhiro Kakiuchi, Anjo (JP)

(73) Assignee: Makita Corporation, Anjo (JP)

( * ) Notice: Subject to any disclaimer, the term of this patent is extended or adjusted under 35 U.S.C. 154(b) by 107 days.

(21) Appl. No.: 10/719,563

(22) Filed: Nov. 20, 2003

(65) Prior Publication Data

US 2004/0108123 A1 Jun. 10, 2004

(30) Foreign Application Priority Data

Nov. 20, 2002 (JP) ..... 2002-337023

(51) Int. Cl.[7] ..... B25D 16/00
(52) U.S. Cl. ..... 173/48; 173/109; 173/201
(58) Field of Search ..... 173/47, 48, 29, 173/201, 109

(56) References Cited

U.S. PATENT DOCUMENTS

| | | | | |
|---|---|---|---|---|
| 4,066,136 | A * | 1/1978 | Wanner et al. | 173/48 |
| 4,446,931 | A * | 5/1984 | Bleicher et al. | 173/48 |
| 4,895,212 | A * | 1/1990 | Wache | 173/48 |
| 5,320,177 | A * | 6/1994 | Shibata et al. | 173/48 |
| 5,873,418 | A * | 2/1999 | Arakawa et al. | 173/212 |
| 6,035,945 | A * | 3/2000 | Ichijyou et al. | 173/48 |
| 6,192,996 | B1 * | 2/2001 | Sakaguchi et al. | 173/48 |
| 6,431,290 | B1 * | 8/2002 | Muhr et al. | 173/201 |
| 6,460,627 | B1 | 10/2002 | Below et al. | |
| 6,557,648 | B2 * | 5/2003 | Ichijyou et al. | 173/48 |

FOREIGN PATENT DOCUMENTS

| | | |
|---|---|---|
| DE | 3712456 A1 | 10/1988 |
| DE | 3732288 A1 | 4/1989 |
| EP | 437716 A1 | 7/1991 |
| JP | 2001-105214 | 4/2001 |

* cited by examiner

*Primary Examiner*—Scott A. Smith
(74) *Attorney, Agent, or Firm*—Lahive & Cockfield, LLP; Anthony A. Laurentano, Esq.

(57) ABSTRACT

A hammer drill (1) includes a lock plate (35) forward of a boss sleeve (13) and a swash bearing (14) which cooperates with the boss sleeve to convert the rotation of an intermediate shaft (5) on which the boss sleeve is mounted. The lock plate is mounted on the boss sleeve and selectively engages claws (23) of the boss sleeve (13) in a manner that permits its integral rotation with and axial slide with respect to the boss sleeve. The lock plate is additionally biased in the forward direction by a coil spring (38) so that when a clutch (19) is shifted forward in a drill mode, the lock plate also moves forward into engagement with a stopper (39) secured to an inner housing (4), preventing inadvertent rotation of the boss sleeve.

20 Claims, 17 Drawing Sheets

(A)

(B)

HAMMER DRILL WITH A MECHANISM FOR PREVENTING INADVERTENT HAMMER BLOWS

RELATED APPLICATION(S)

This application claims priority on Japanese Patent Application No. 2002-337023 filed on Nov. 20, 2002.

BACKGROUND OF THE INVENTION

1. Field of the Invention

The present invention generally relates to electric power tools. More particularly, the present invention relates to a hammer drill which allows selection of at least a drill mode and a hammer drill mode.

2. Description of the Related Art

A known hammer drill offers two selectable operating modes, a drill mode and a hammer drill mode. In the drill mode, the tool bit held by a chuck or other means at the top end of the housing is allowed to rotate without performing any percussive or hammer action. In the hammer drill mode, however, in addition to the rotary operation, a striker reciprocating rear of the tool bit delivers hammer blows either directly to the bit or indirectly to the bit via an impact bolt abutting the rear end of the bit. In this arrangement, as disclosed in Japan Published Unexamined Patent Application No. 2001-105214, a gear is fitted on a tool holder to the top end of which a tool bit is secured. The gear engages an intermediate shaft which is rotatably driven by the rotation of the output shaft of the motor so as to transmit the rotation of the intermediate shaft to the tool holder. Furthermore, a separate sleeve member is rotatably fitted on the intermediate shaft, and a swash bearing with an integrally provided connecting arm is in turn fitted on the outer surface of the sleeve member at an angle to the axis of the sleeve member. The top end of the connecting arm of the swash bearing is coupled to a piston cylinder inserted into the tool holder from the rear so as to convert the rotary motion of the intermediate shaft to the reciprocating motion of the piston cylinder. Accordingly, as the rotation of the intermediate shaft causes reciprocating motion in the piston cylinder, a striker disposed within the piston cylinder is likewise set in reciprocating motion, thereby delivering repeated blows to the tool bit in front of the striker.

In order to provide for the selection of the operating mode, a clutch is disposed on the intermediate shaft in a manner that permits its integral rotation with the intermediate shaft and its axial slide with respect to or independently of the intermediate shaft. Coupled to the clutch is a switching member that is integrally slidable with the clutch but not integrally rotatable therewith. The switching member is operated from the exterior of the tool so as to slide the clutch between a first position, in which the clutch engages or connects with the sleeve member, and a second position, in which the clutch is disengaged or disconnected from the sleeve member. In the first position, the power tool operates in the hammer drill mode, in which the tool holder is rotated and the piston cylinder is also caused to reciprocate by the rotation of the sleeve member, thus delivering hammer blows to the bit. In the second position, the power tool is placed in the drill mode, in which only the tool holder but not the sleeve member is caused to rotate.

While this arrangement achieves its intended objective, it is not free from certain problems and inconveniences. For example, although the sleeve member is disengaged from the clutch when the drill mode is selected, the friction developing between the outer peripheral surface of the rotating intermediate shaft and the inner peripheral surface of the stationary sleeve member may inadvertently cause the piston cylinder to rotate. Such rotation of the piston cylinder also causes the striker to reciprocate, and thus delivering hammer blows to the tool bit.

SUMMARY OF THE INVENTION

In view of the above-identified problems, an important object of the present invention is to provide a hammer drill that reliably prevents inadvertent blows to the bit when the tool is in the drill mode.

The above objects and other related objects are realized by the invention, which provides a hammer drill comprising: a bit; a housing; a piston member disposed rear of the bit for making reciprocating motion; a motor capable of rotation; an intermediate shaft capable of being rotated by the rotation of the motor transmitted thereto; a rotation mechanism for transmitting rotation of the motor to rotate the bit; a conversion mechanism for converting the rotation of the intermediate shaft into reciprocating motion of the piston member; a striking mechanism including a striker interlocked with the piston member for causing the striker to deliver hammer blows to the bit; and a switch member for selectively preventing the rotation of the motor from being transmitted to the conversion mechanism. The switch member is operable from outside of the housing to select one of at least two operating modes, a drill mode, in which only the rotation of the motor is transmitted to the bit, and a hammer drill mode, in which the rotation of the motor and the hammer blows are transmitted to the bit. The hammer drill further comprises a lock mechanism interlocked with the switch member such that the lock mechanism can prohibit the reciprocating motion of the piston member only in the drill mode. The lock mechanism ensures that hammer blows are not delivered to the tool bit in the drill mode, thereby enhancing the reliability of the hammer drill.

According to one aspect of the present invention, the hammer further comprises a clutch slidably mounted on and integrally rotatable with the intermediate shaft. In addition, the conversion mechanism includes a sleeve member mounted on the intermediate shaft and capable of integral rotation with the intermediate shaft. The switch member is adapted to slide the clutch into connection with the sleeve member. The lock mechanism includes: a lock plate which is mounted on the sleeve member between the clutch and the sleeve member and is capable of integral rotation with the sleeve member and axial slide with respect to the sleeve member; biasing means for biasing the lock plate toward the clutch; and a stopper secured within the housing. The stopper engages the lock plate when the lock plate slides to the stopper upon disconnection of the clutch from the sleeve member. One advantage of the lock mechanism is the ease with which it can be constructed.

According to another aspect of the present invention, the sleeve member includes at least one claw, whereas the lock plate has an annular shape including at least one protrusion which is provided on an inner edge thereof and which remains in engagement with the at least one claw of the sleeve member regardless of the slide position of the clutch. The lock plate further includes at least one recess provided in an outer edge thereof and capable of engaging a projection provided on the stopper following the disconnection of the clutch from the sleeve member, thus preventing the lock plate and thus the sleeve member from rotation.

According to still another aspect of the present invention, when the clutch is slid forward and away from the sleeve member, the biasing force of the biasing means slides the lock plate forward so as to engage one of the recesses of the lock plate with the projection of the stopper while maintaining the engagement between the at least one protrusion of the lock plate and the at least one claw of the sleeve member.

According to yet another aspect of the present invention, when the clutch is slid forward and away from the sleeve member, the biasing force of the biasing means slides the lock plate forward into engagement with the stopper while maintaining the engagement between the lock plate and the sleeve member.

In one aspect, the biasing means is a coil spring interposed between the lock plate and the sleeve member, and the conversion mechanism further includes a swash bearing with a connecting rod coupled to the piston member and capable of imparting reciprocating motion to the piston member.

In one embodiment of the present invention, the clutch, the lock plate, the biasing means, and the sleeve member are coaxially arranged on the intermediate shaft with the clutch located forward of the sleeve member.

In one aspect, the lock plate remains in engagement with the sleeve member regardless of the slide position of the clutch. In the drill mode, the stopper interferes with and prevents the rotation of the lock plate while engaging the lock plate. Moreover, when the clutch is slid into connection with the sleeve member by the operation of the switch member, the lock plate is slid and disengaged by the clutch from the stopper so as to allow integral rotation of the lock plate with the sleeve member.

In one embodiment, the hammer drill further comprises a second biasing means mounted around the intermediate member for biasing the switch member toward the clutch, causing the clutch to engage the sleeve member in the hammer drill mode.

In one embodiment of the present invention, the hammer drill further comprises a clutch slidably mounted on and integrally rotatable with the intermediate shaft. In this embodiment, the conversion mechanism includes a sleeve member mounted on the intermediate shaft and capable of integral rotation with the intermediate shaft, and the switch member is adapted to slide the clutch into connection with the sleeve member. Furthermore, the lock mechanism includes a lock member provided on a portion of the sleeve member adjacent to the clutch and integrally rotatable with the sleeve member. The lock mechanism additionally includes an engaging member provided on the switch member. In the drill mode, the engaging member is located in a position where the engaging member engages the lock member. One advantage of the lock mechanism is the ease with which it can be constructed.

According to one aspect of the invention, the lock member includes a reduced diameter section mounted on a forward portion of the sleeve member. Additionally included in the lock member is a cylindrical large diameter section provided between the reduced diameter section and the clutch and extending forward from the reduced diameter section. The large diameter section has an outer peripheral surface and a plurality of axial grooves provided in the outer peripheral surface, and further the large diameter section is configured to receive the clutch therein. In addition, the engaging member includes an elongated portion extending rearward from the switch member along the outer peripheral surface of the large diameter section. The engaging member includes also an engaging tip provided at a rear end of the elongated portion and bent toward the lock member for engaging one of the axial grooves in the drill mode so as to prevent the rotation of the lock member.

According to another aspect of the invention, the switch member is slidable at least between a forward position, corresponding to the drill mode, in which the engaging tip engages one of the axial grooves and a rear position, corresponding to the hammer drill mode, in which the engaging tip is located rear of the axial grooves, thus not engaging any of the axial grooves.

According to still another aspect of the invention, an axial length of the elongated portion is set such that the engaging tip engages one of the axial grooves of the lock member only when the switch member is in the forward position and the engaging tip is located rear of the large diameter section, when the switch member is in the rear position.

According to one embodiment of the invention, the lock mechanism is a limiting member provided integrally with the switch member and capable of being positioned within a range of the reciprocating motion of the piston member in the drill mode for interfering with the piston member and limiting the reciprocating motion of the piston member. As the limiting member comes into direct contact with the piston member, this arrangement can highly reliably prevent inadvertent hammer blows in the drill mode.

In one aspect of the present invention, the piston member has a center axis along which the piston member reciprocates between a first position and a second position rear of the first position. The limiting member includes a forward portion extending rearward from the switch member and a rear end portion coupled to a rear end of the forward portion and bent toward the center axis of the piston member. In the drill mode, the rear end portion of the limiting member is positioned forward of the second position of the piston member.

In another aspect, the switch member is slidable at least between a forward position, corresponding to the drill mode, in which the rear end portion of the limiting member is positioned forward of the second position of the piston member, and a rear position, corresponding to the hammer drill mode, in which the rear end portion of the limiting member is positioned rear of the range of the reciprocating motion of the piston member, thus permitting the piston member to reciprocate between the first and second positions thereof.

In still another aspect, the forward portion of the limiting member extends in parallel with the center axis of the piston member and the rear end portion of the limiting member extends perpendicularly from a rear end of the forward portion.

In yet another aspect, the forward portion of the limiting member extends in parallel with the center axis of the piston member, and the rear end portion of the limiting member extends from a rear end of the forward portion and is bent perpendicularly three times.

In one embodiment, the hammer drill further comprises a second biasing means mounted around the intermediate member for biasing the switch member toward the clutch, causing the clutch to engage the sleeve member in the hammer drill mode.

In another embodiment, the hammer drill further comprises a clutch slidably mounted on and integrally rotatable with the intermediate shaft. The drill also comprises a pin secured within the housing and penetrating the switch member and a second biasing means mounted around the pin between the switch member and a free end of the pin. The second biasing means, such as a coil spring, biases the switch member toward the clutch, causing the clutch to engage the sleeve member in the hammer drill mode.

Other general and more specific objects of the invention will in part be obvious and will in part be evident from the drawings and descriptions which follow.

BRIEF DESCRIPTION OF THE ATTACHED DRAWINGS

For a fuller understanding of the nature and objects of the present invention, reference should be made to the following detailed description and the accompanying drawings, in which.

Figure 1:
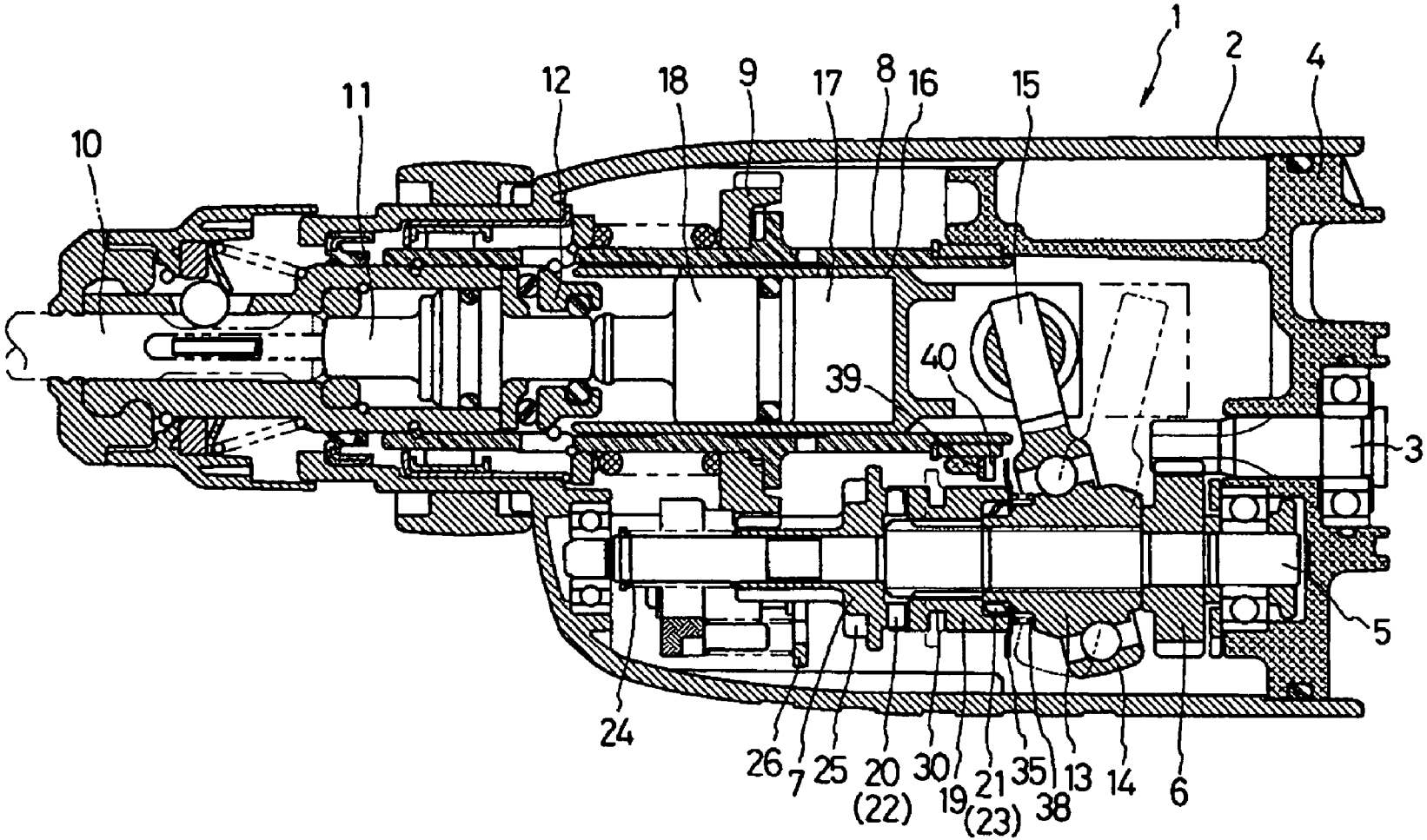
FIG. 1 is a partial cross-sectional side view of an essential part of a hammer drill 1 in accordance with the present invention.
Figure 4A:
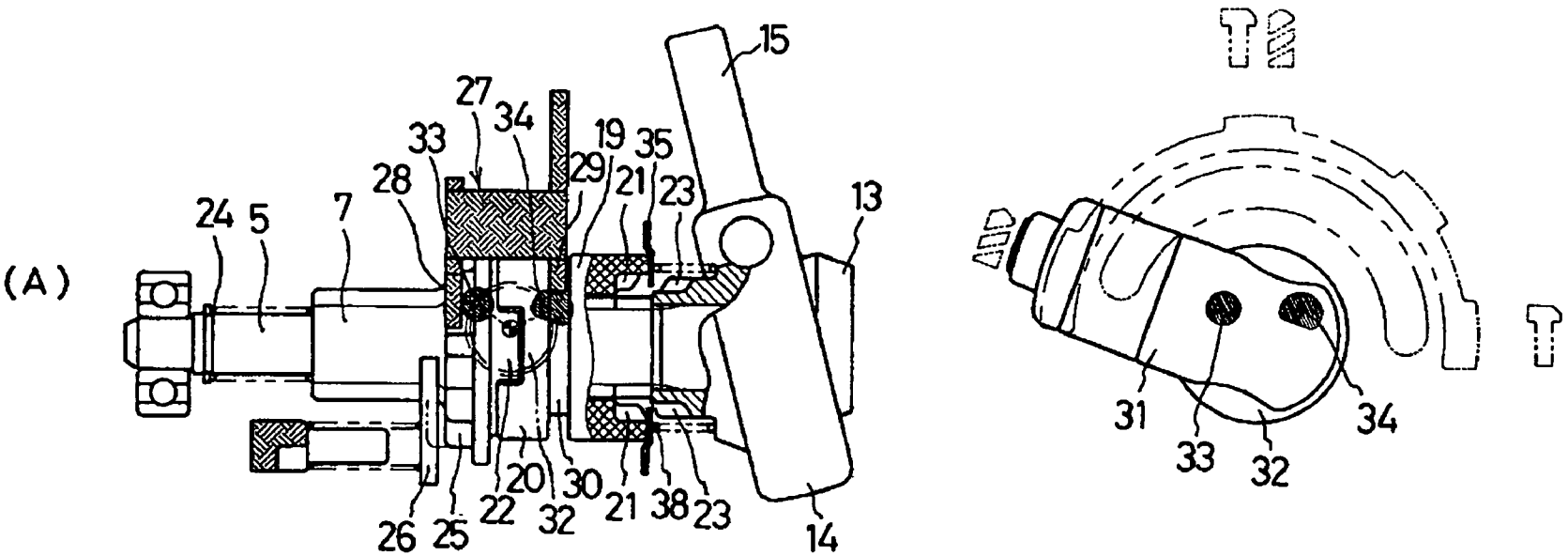
Figure 4B:
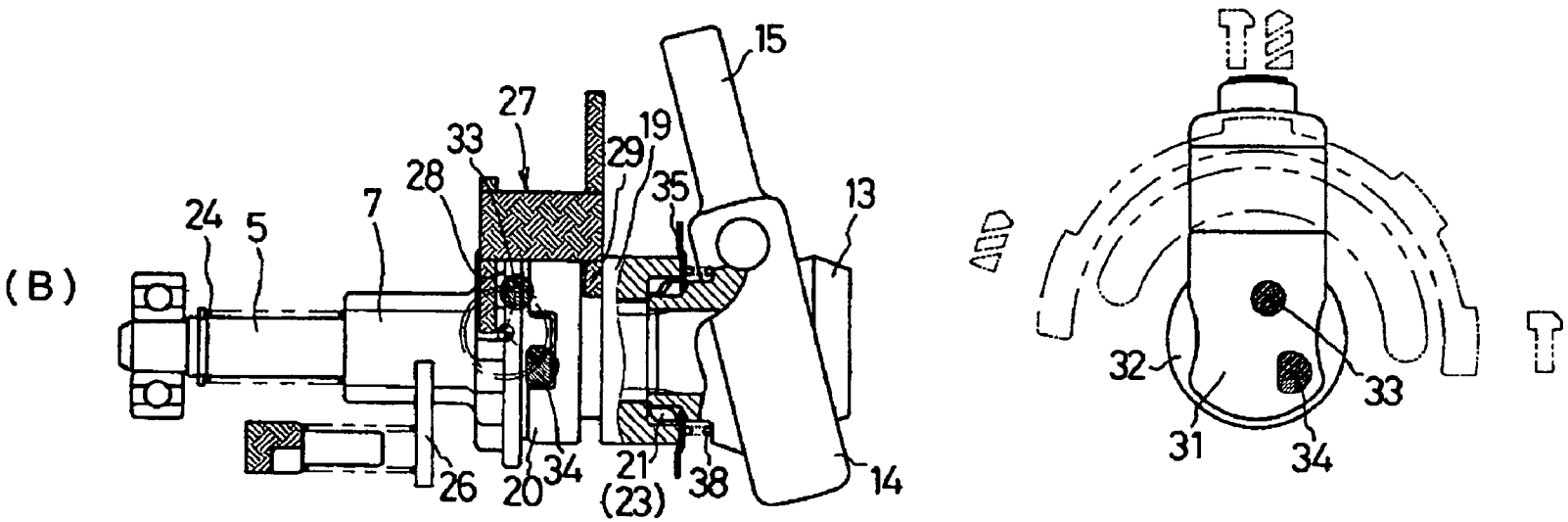
Figure 5A:
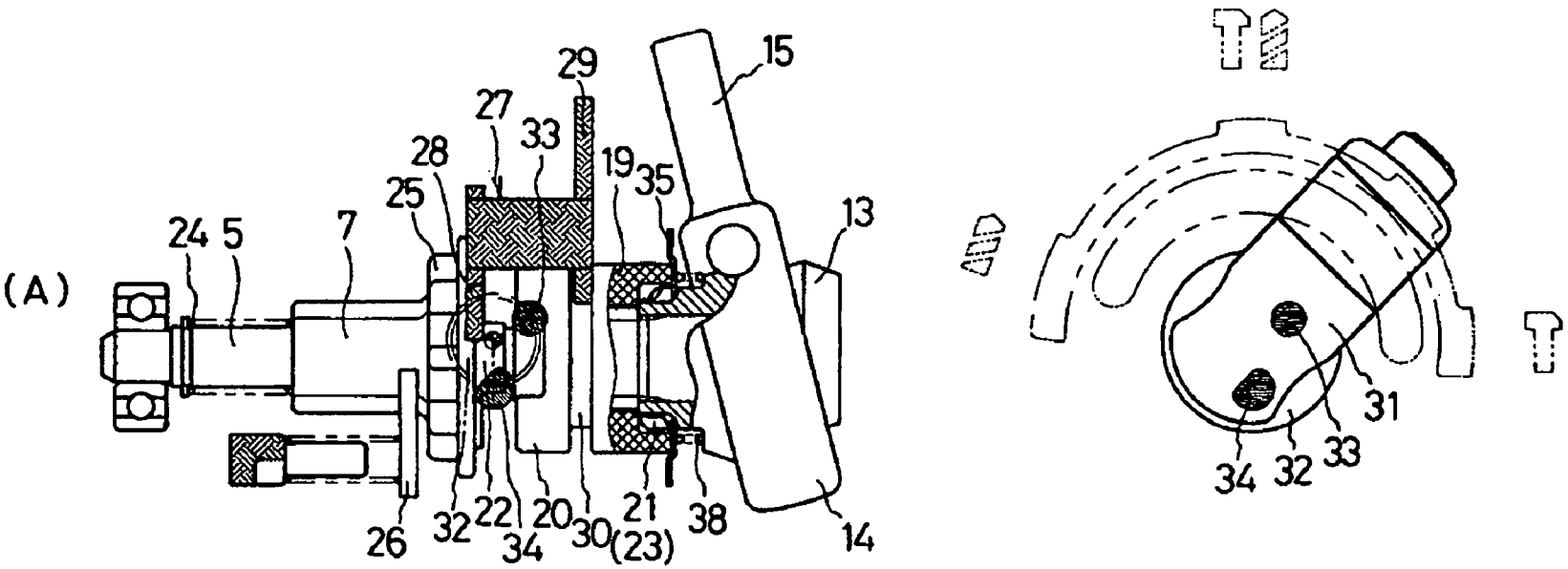
Figure 5B:
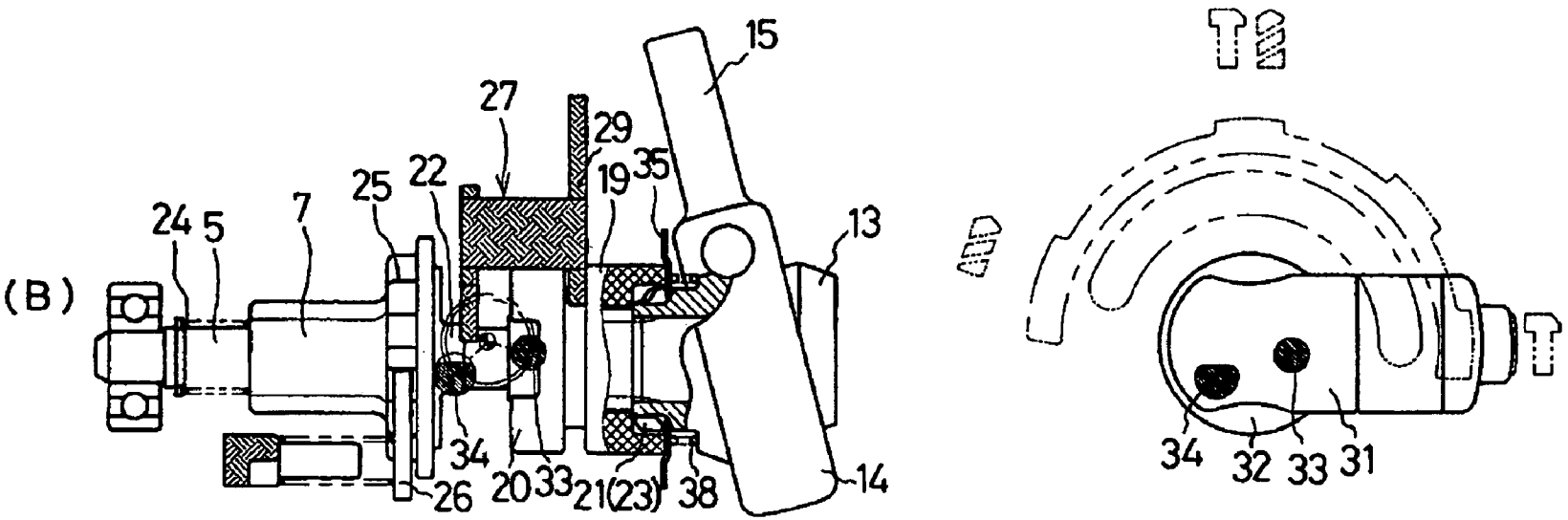
Figure 6:
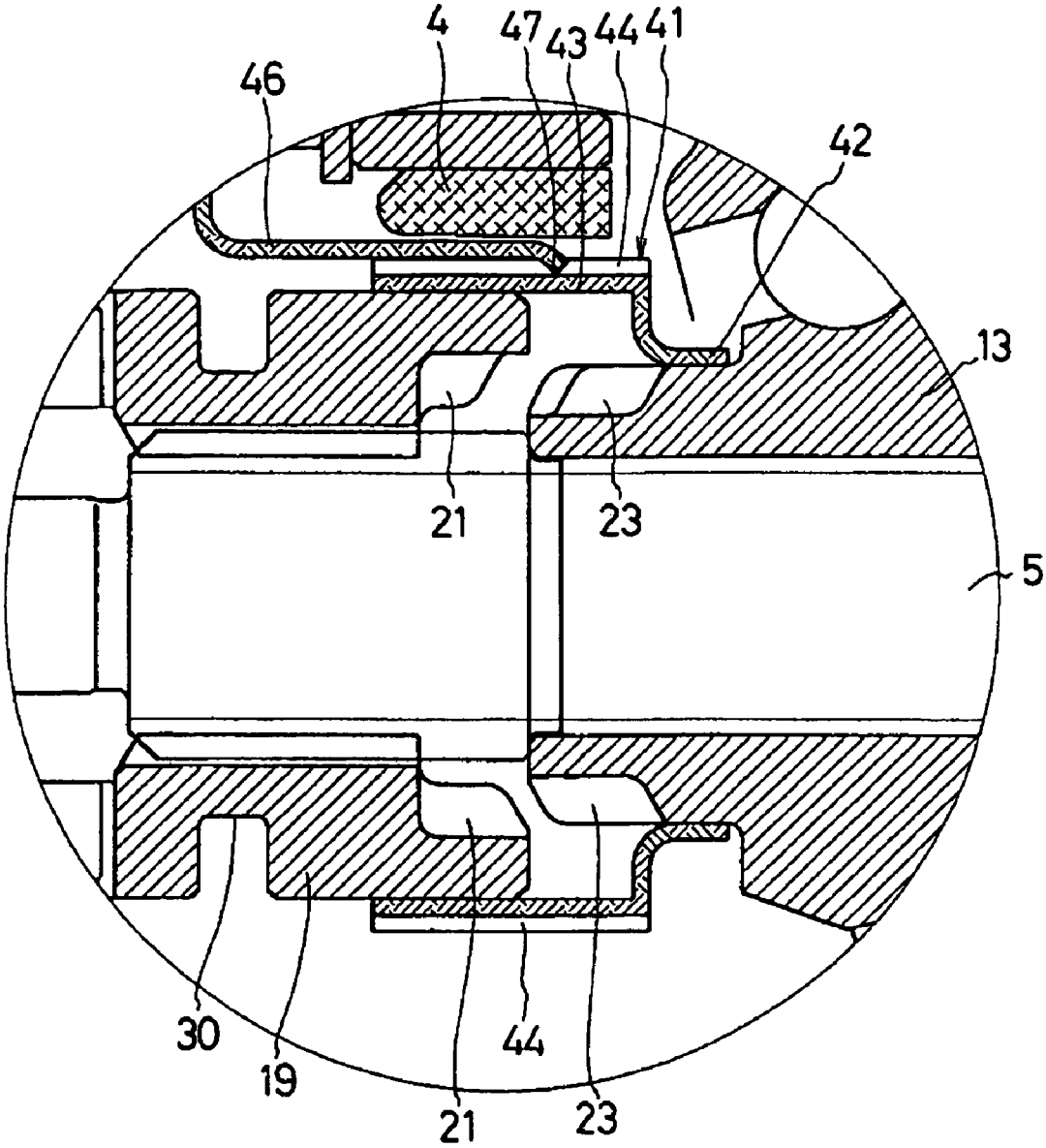
Figure 7A:
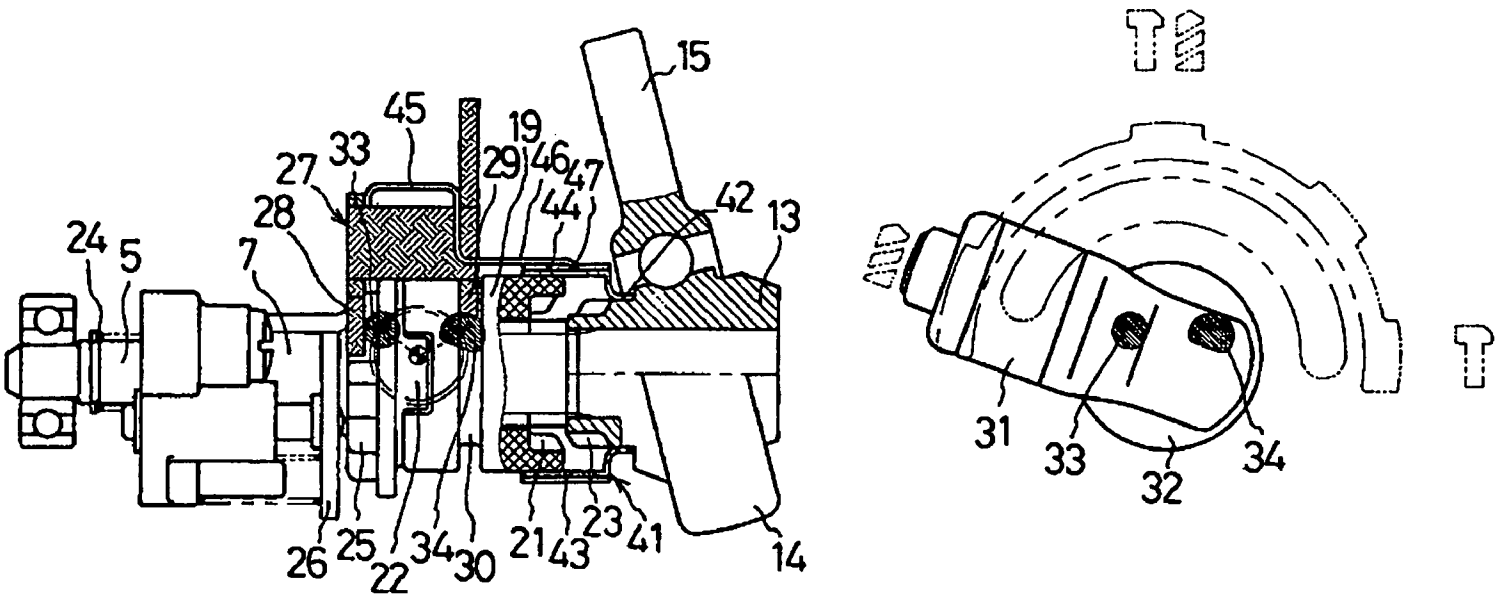
Figure 7B:
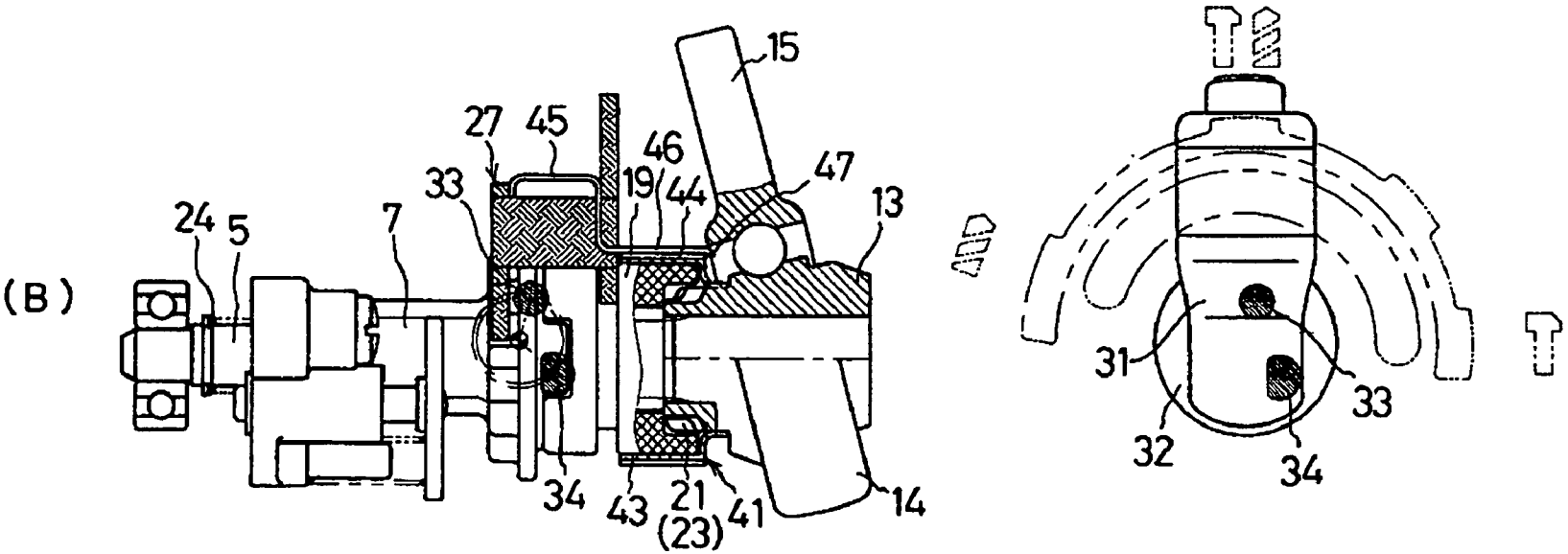
Figure 8A:
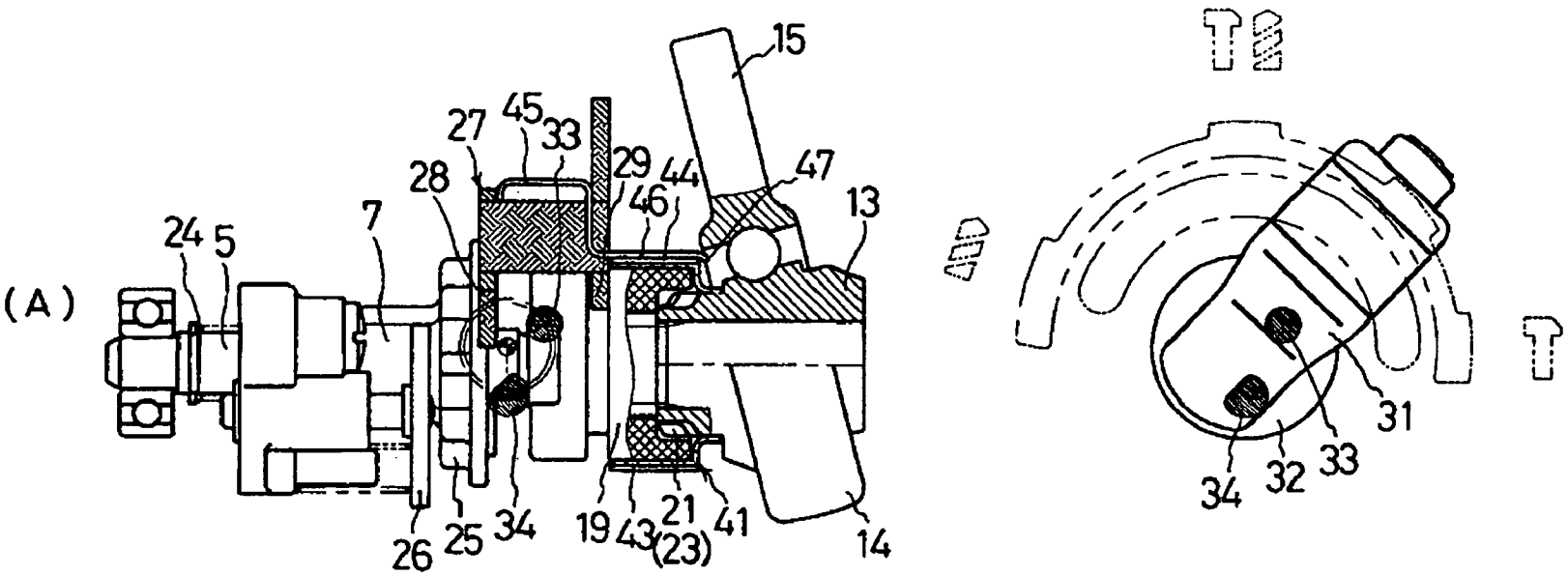
Figure 8B:
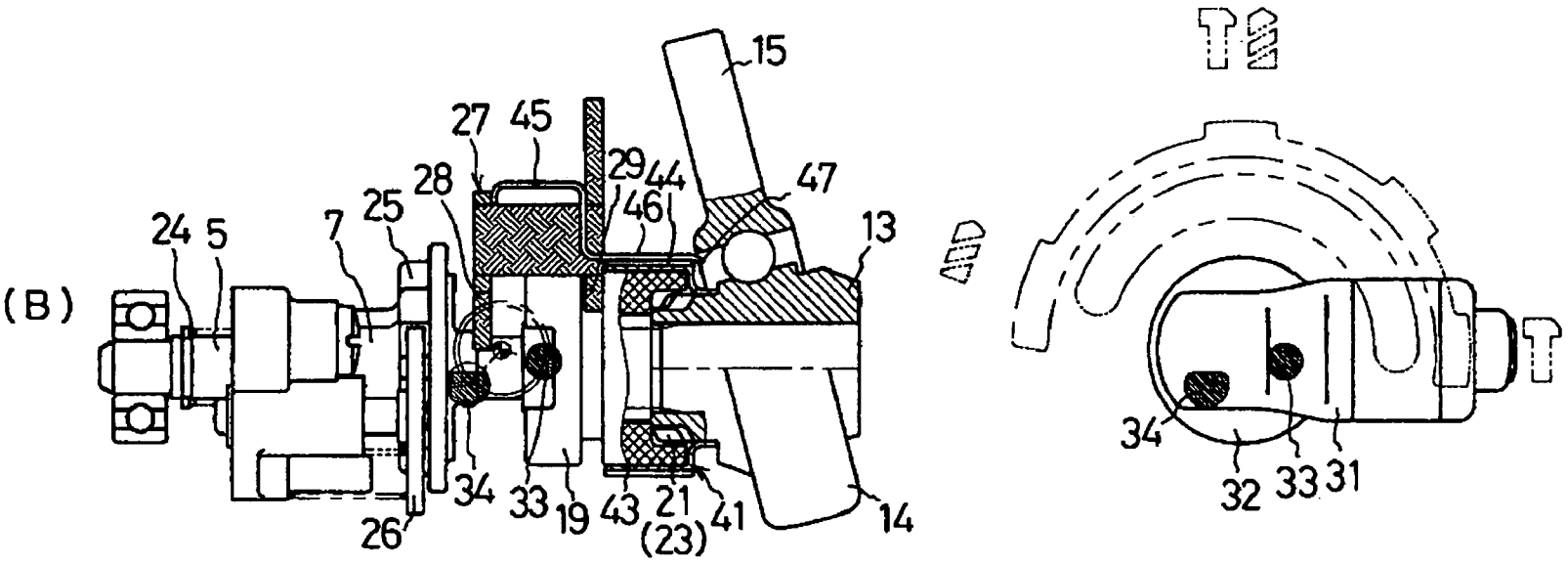
Figure 9:
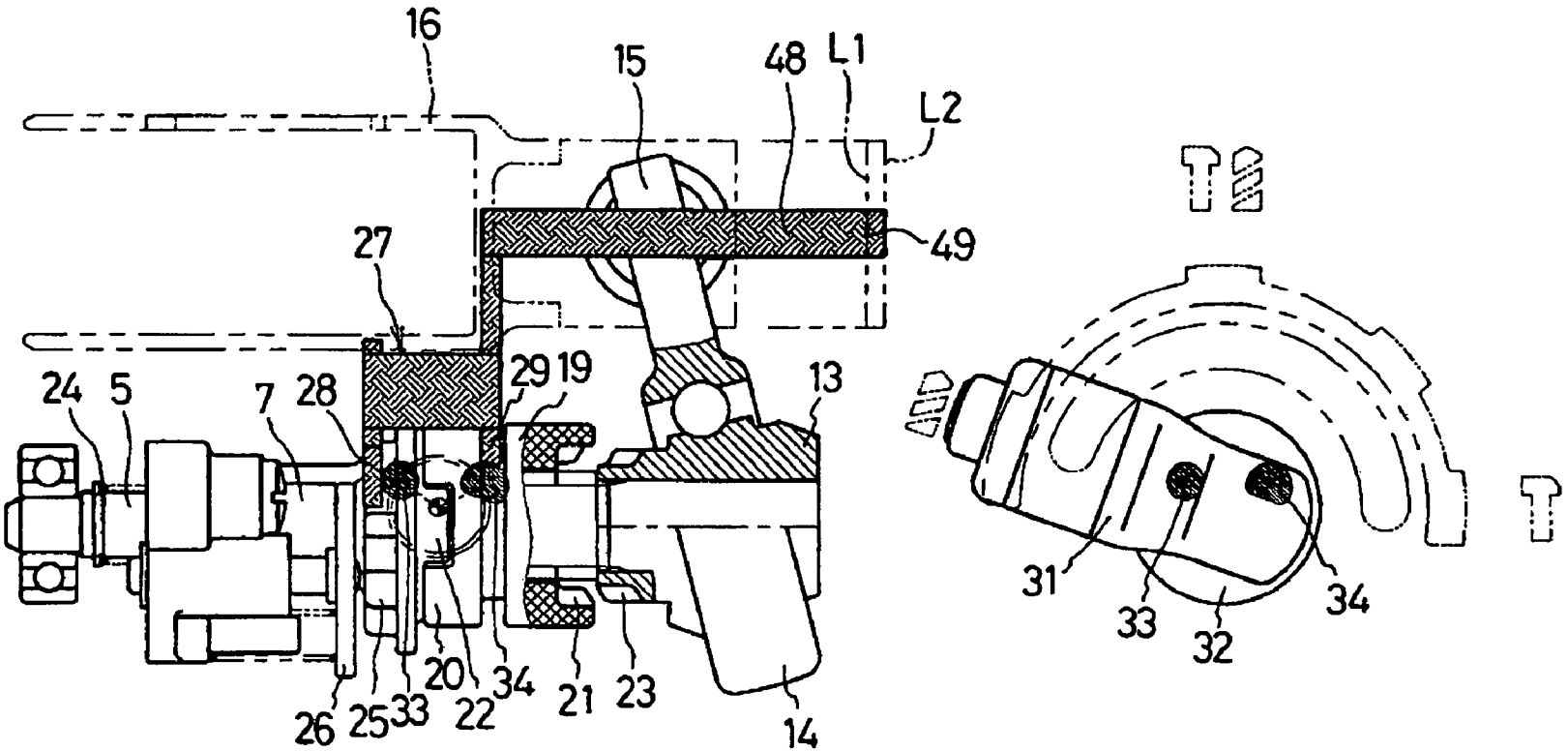
Figure 10:
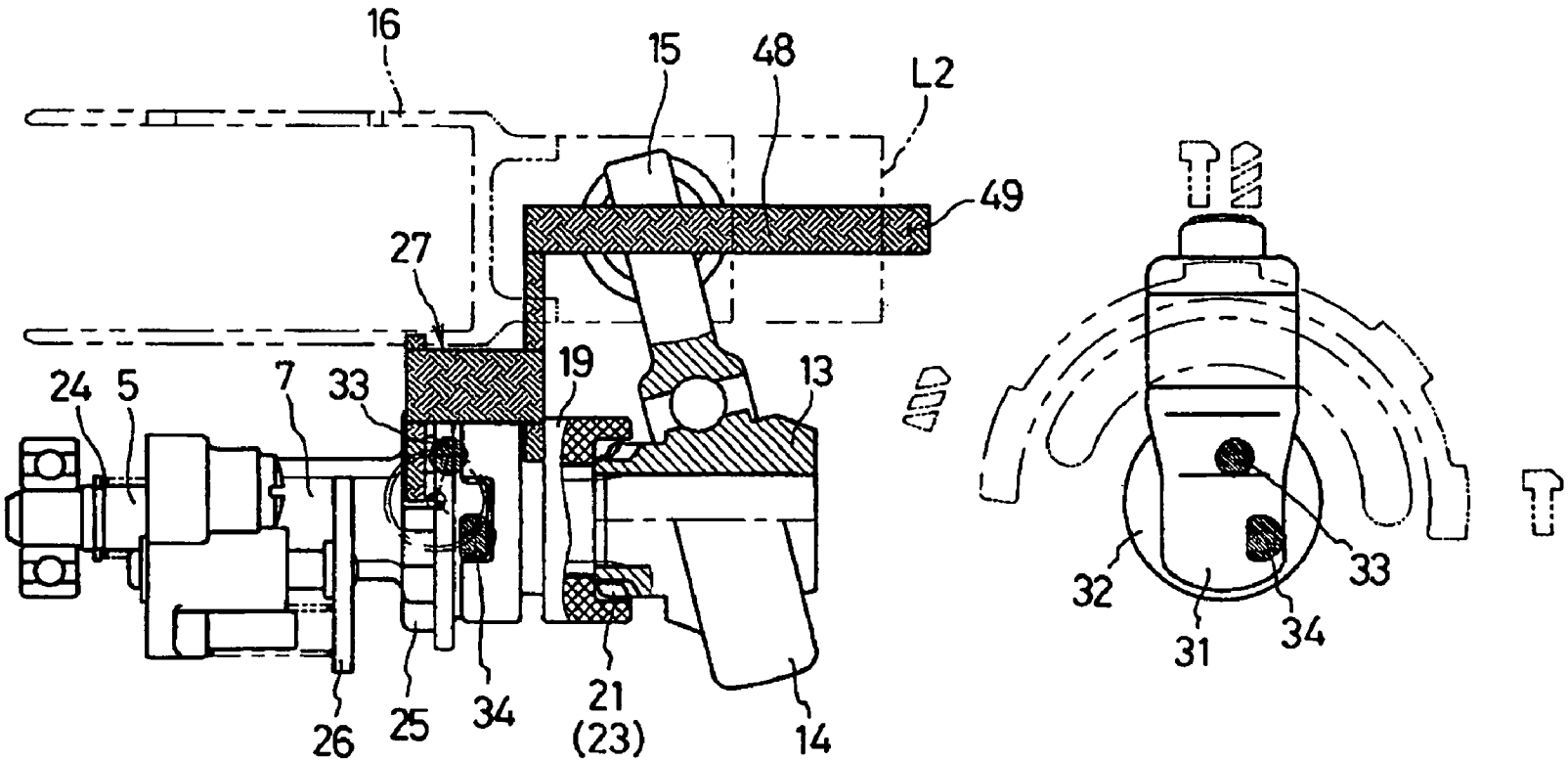
Figure 11:
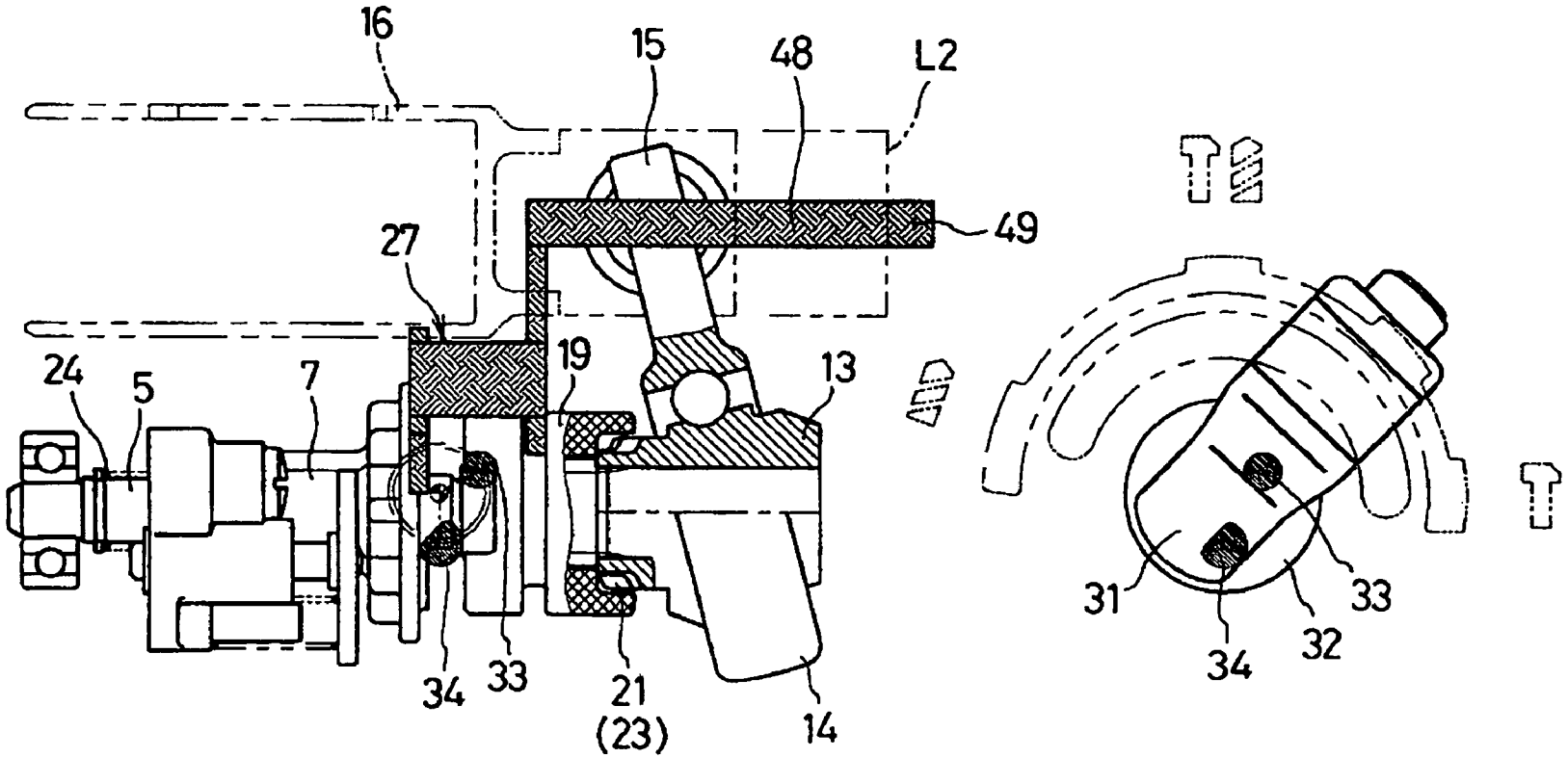
Figure 12:
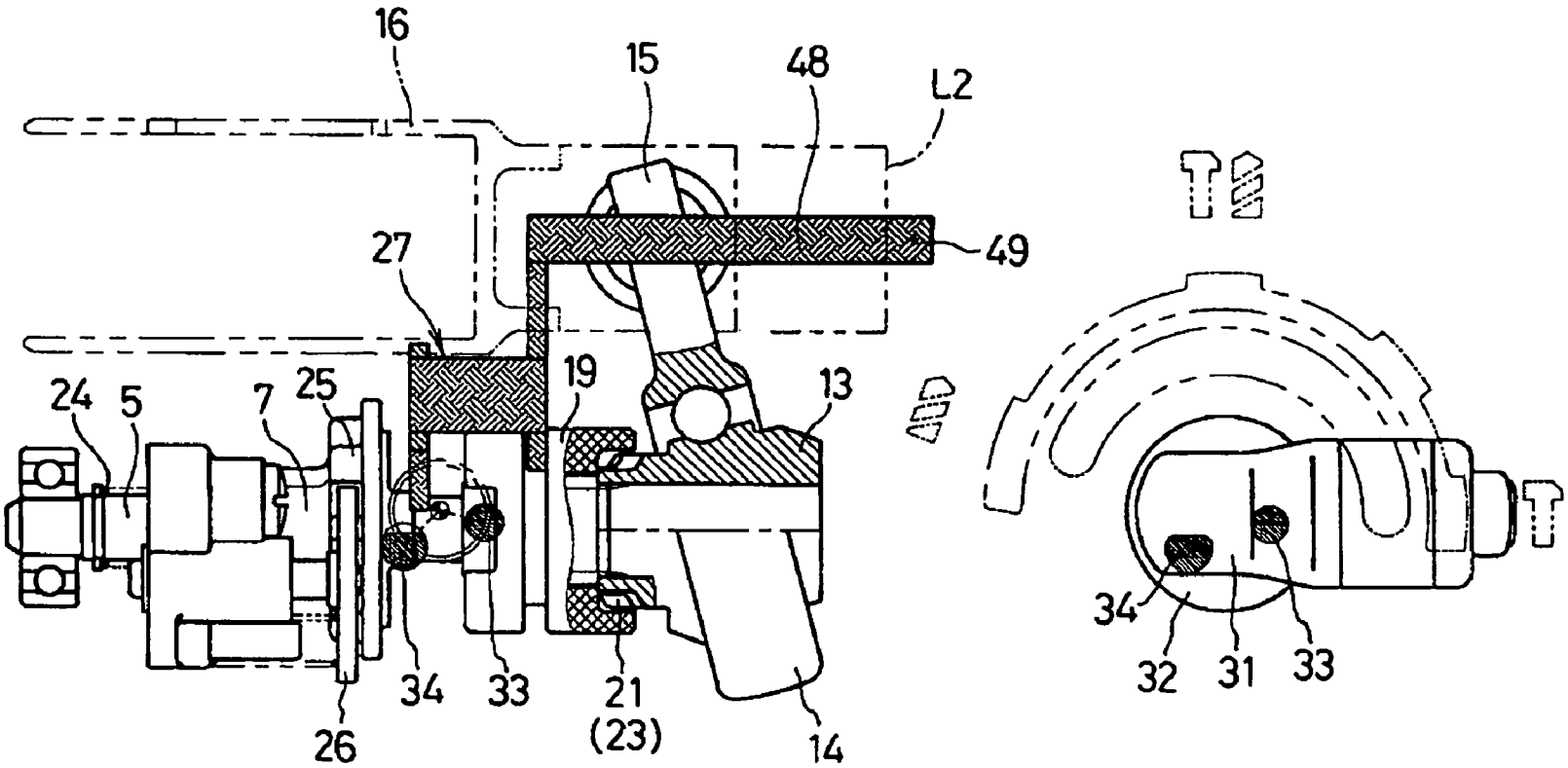
Figure 13:
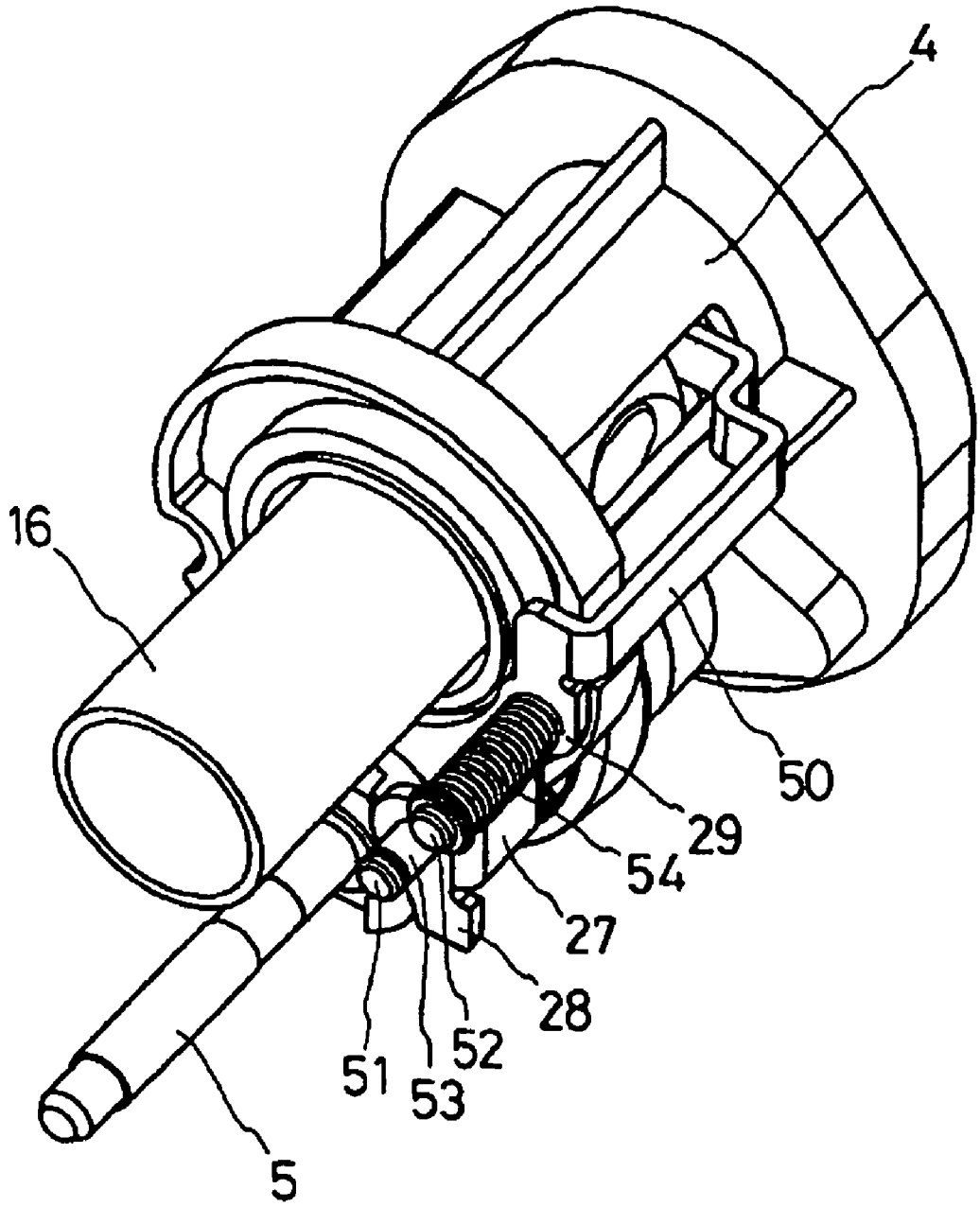

FIG. 4A includes side views explaining the operation of the clutch and the switch lever of the hammer drill shown in FIG. 1 to select the drill mode;

FIG. 4B includes side views explaining the operation of the clutch and the switch lever of the hammer drill shown in FIG. 1 to select the hammer drill mode;

FIG. 5A includes side views explaining the operation of the clutch and the switch lever of the hammer drill shown in FIG. 1 to select the neutral mode;

FIG. 5B includes side views explaining the operation of the clutch and the switch lever of the hammer drill shown in FIG. 1 to select the hammer mode;

FIG. 6 is an enlarged view of the clutch mechanism of the hammer drill according to a second embodiment;

FIG. 7A includes side views explaining the operation of the clutch and the switch lever of the hammer drill shown in FIG. 6 to select the drill mode;

FIG. 7B includes side views explaining the operation of the clutch and the switch lever of the hammer drill shown in FIG. 6 to select the hammer drill mode;

FIG. 8A includes side views explaining the operation of the clutch and the switch lever of the hammer drill shown in FIG. 1 to select the neutral mode;

FIG. 8B includes side views explaining the operation of the clutch and the switch lever of the hammer drill shown in FIG. 1 to select the hammer mode;

FIG. 9 includes side views explaining the operation of the clutch and the switch lever of the hammer drill of a third embodiment to select the drill mode;

FIG. 10 includes side views explaining the operation of the clutch and the switch lever of the hammer drill of the third embodiment to select the hammer drill mode;

FIG. 11 includes side views explaining the operation of the clutch and the switch lever of the hammer drill of the third embodiment to select the neutral mode;

FIG. 12 includes side views explaining the operation of the clutch and the switch lever of the hammer drill of the third embodiment to select the hammer mode; and FIG. 13 is a perspective view of an alternative clutch mechanism according to the present invention that may substitute for the clutch mechanism of the third embodiment.

DETAILED DESCRIPTION OF THE PREFERRED EMBODIMENTS

Preferred embodiments of the present invention will be described hereinafter with reference to the attached drawings.

Embodiment 1

FIG. 1 is a partial cross-sectional side view of an essential part of a hammer drill 1 in accordance with the present invention. The hammer drill 1 includes a housing 2 which accommodates a motor (not shown) in the rear (to the right of FIG. 1) of the housing 2. The motor has an output shaft 3 rotatably supported by an inner housing 4 which is assembled to the interior of the housing 2. The output shaft 3 protrudes in the forward direction into the housing 2 and engages or meshes with a first gear 6 of an intermediate shaft 5 rotatably supported in parallel with the output shaft 3 within the housing 2. A separate second gear 7 is disposed on the forward portion of the intermediate shaft 5 in a manner that allows the second gear 7 to integrally rotate with the intermediate shaft 5 and axially slide with respect to or independently of the shaft 5. The second gear 7 engages a third gear 9 which rotates integrally with a tool holder 8 disposed in parallel with the intermediate shaft 5 within the housing 2. The tool holder 8 is adapted to securely receive a tool bit 10 therein. Provided behind the tool bit 10 is an impact bolt 11 capable of motion back and forth within the tool holder 8. Secured within the tool holder 8 is a ring member 12 that limits the rearward movement of the impact bolt 11.

Rotatably mounted on the intermediate shaft 5 forward of the first gear 6 is a sleeve member, such as a boss sleeve 13. A swash bearing 14 is rotatably mounted on the outer peripheral surface of the boss sleeve 13 with its axis tilted with respect to the center axis of the intermediate shaft 5. The swash bearing 14 includes at its top a connecting arm 15 which is coupled to the rear end of a piston member, such as a piston cylinder 16. This piston cylinder 16 is inserted into the tool holder 8 from the rear and accommodates therein a striker 18 in a manner that allows the striker 18 to move back and forth via an air chamber 17 defined between the rear end of the striker 19 and the rear end of the piston cylinder 16.

The hammer drill 1 further includes a tubular clutch 19 disposed around the intermediate shaft 5 between the boss sleeve 13 and the second gear 7. The clutch 19 is spline-connected to the intermediate shaft 5 in a manner that allows the clutch 19 to rotate integrally with the intermediate shaft 5 and slide with respect to the intermediate shaft 5. The clutch 19 includes a plurality of clutch claws 20 provided on the forward end thereof and a plurality of clutch claws 21 provided on the rear end thereof. The front clutch claws 20 are adapted to engage a plurality of claws 22 formed on the rear surface of the second gear 7, whereas the rear clutch claws 21 are adapted to engage a plurality of claws 23 formed on the front surface of the boss sleeve 13. Fitted on the intermediate shaft 5 forward of the second gear 7 is a coil spring 24 that biases the second gear 7 in the rearward direction. When the second gear 7 is slid to its rear position by the biasing force of the coil spring 24, as shown in FIG. 1, the clutch 19 engages or connects with both of the second gear 7 and the boss sleeve 13 so as to cause these two elements to rotate integrally with each other. Furthermore, a plurality of lock claws 25 is provided around the rear peripheral surface of the second gear 7. Provided to a side of the second gear 7 forward of the lock claws 25 is an arc plate 26 adapted to mesh with the lock claws 25 when the second gear 7 is in its forward position.

As shown in FIG. 4, provided to a side of the clutch 19 is a switch plate 27 slidable in axial directions and including a front plate 28 and a rear plate 29 disposed in parallel with each other. The rear plate 29 of the switch plate 27 is inserted in the circular groove 30 provided around the clutch 19. The rear plate 29 is connected to the clutch 19 in a manner that allows the rear plate 29 to slide together with the clutch 19 but not rotate with the clutch 19. Accordingly, the rear plate 29 is biased rearward with the clutch 19 by the coil spring 24. A switch lever 31 is provided on the housing 2 so as to be pivotal on a cylindrical member 32. The cylindrical member 32 includes first and second pins 33 and 34, respectively, protruding from decentered positions proximate to the front plate 28 of the switch plate 27. As the rotation of the switch lever 31 moves the first and second pins 33 and 34, the slide position of the switch plate 27 and the clutch 19 can be changed accordingly, as described in further detail below.

Figure 2:
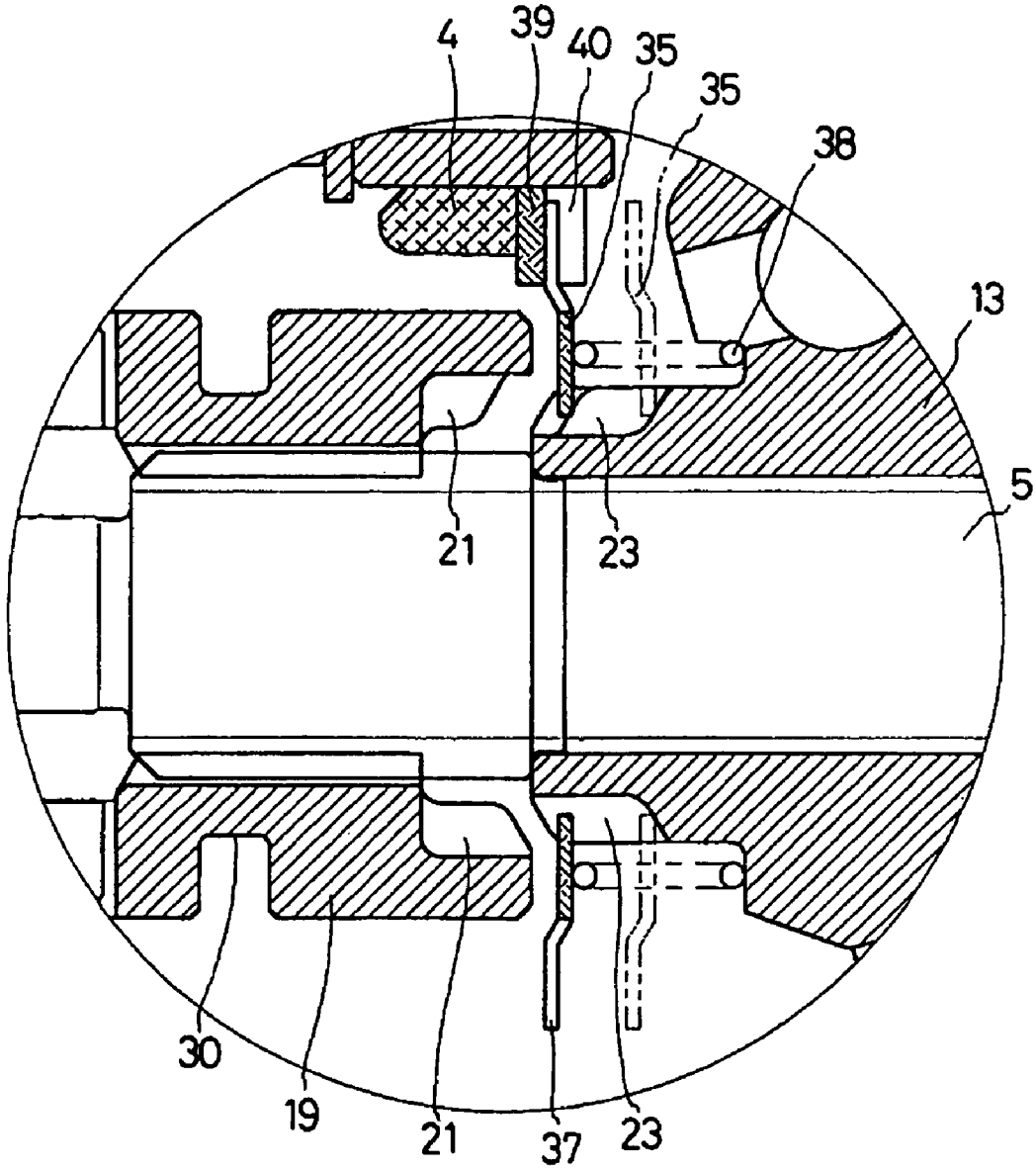
FIG. 2 is an enlarged view of the clutch mechanism of the hammer drill shown in FIG. 1.
Figure 3:
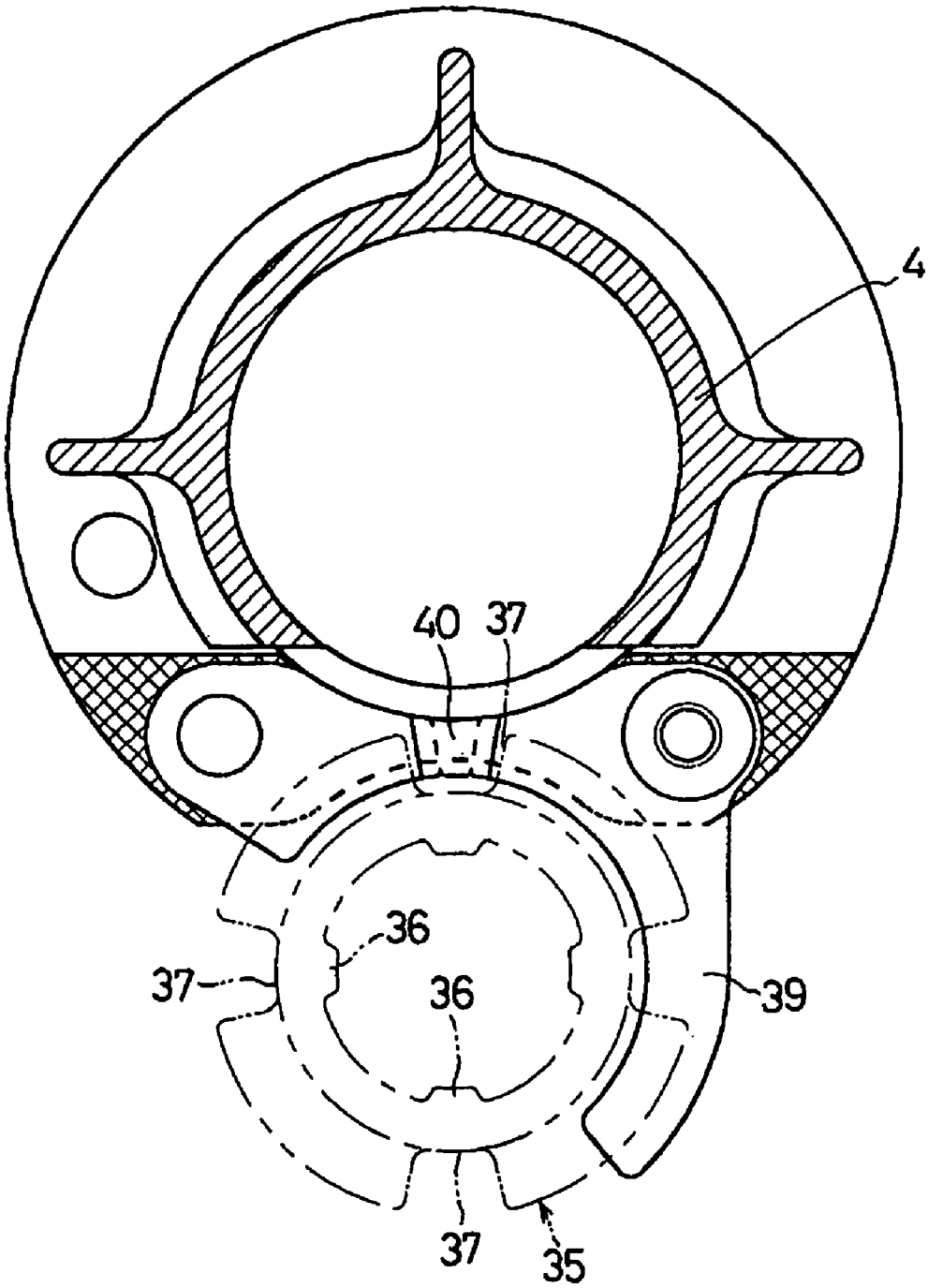
FIG. 3 is a partially enlarged cross-sectional view of the lock plate of the hammer drill shown in FIG. 1.

Referring to FIGS. 1–3, a lock plate 35 is provided between the boss sleeve 13 and the clutch 19. As best shown in FIG. 3, the lock plate 35 generally has an annular or disk shape including a plurality of protrusions 36 provided on its inner edge at regular intervals and adapted for engagement with claws 23 of the boss sleeve 13. The lock plate 35 additionally includes a plurality of recesses 37 provided in its outer edge or periphery also at regular intervals. Furthermore, the lock plate 35 is mounted around the intermediate shaft 5 in a manner that permits the plate 35 to slide axially with respect to the boss sleeve 13 and rotate integrally with the boss sleeve 13. The lock plate 35 is biased forward by a biasing means, such as a coil spring 38, interposed between the lock plate 35 and the boss sleeve 13. When the clutch 19 is in its forward position, the lock plate 35 comes into abutment with a stopper 39 secured to the inner housing 4 so that the plate 35 is prevented from moving any further forward. When the lock plate 35 abuts the stopper 39, one of the peripheral recesses 37 engages a projection 40 provided on the stopper 39, thus prohibiting rotation of the lock plate 35. As the protrusions 36 of the lock plate 35 likewise engage the claws 23 of the boss sleeves 13, the boss sleeve is also secured against rotation (the position of the lock plate indicated in solid lines in FIG. 2). Conversely, when the clutch 19 is moved rearward into connection with the boss sleeve 13, the lock plate 35 is also pushed rearward by the clutch 19, resulting in disengagement or disconnection from the stopper 39 (the position of the lock plate indicated in two-dot chain lines in FIG. 2).

In a hammer drill 1 thus constructed, as shown in FIG. 4A, when the switch lever 31 is rotated counterclockwise to the leftmost position, the first pin 33 moves the switch plate 27 in the forward direction against the biasing force of the coil spring 24, thus disengaging the clutch 19 from the boss sleeve 13. As the clutch 19 is moved forward in this manner, the biasing force of the coil spring 38 moves the lock plate 35 likewise in the forward direction into abutment with the stopper 39. It should be noted that in this state, the second gear 7, biased rearward, remains in engagement with the clutch 19. Accordingly, upon activation of the motor, the intermediate shaft 5 is rotated by the motor. The rotation of the intermediate shaft 5 is subsequently transmitted to the tool holder 8 via the clutch 19 and the second and third gears 7 and 9, respectively. However, as the clutch 19 is disengaged from the boss sleeve 13, the rotation of the intermediate shaft 5 cannot be transmitted to the boss sleeve 13, thus not causing the piston cylinder 16 to reciprocate. In this switch lever position, therefore, the hammer drill 1 operates in the: drill mode, causing the bit 10 to rotate without permitting the piston cylinder 16 to reciprocate.

In the drill mode, the lock plate 35 is prevented from rotation by the stopper projection 40. As the boss sleeve 13 can only rotate with the lock plate 35, rotation of the boss sleeve 13 is also prevented. Accordingly, even when the friction that develops between the outer peripheral surface of the intermediate shaft 5 in rotation and the inner peripheral surface of the stationary boss sleeve 13 exerts a force on the boss sleeve 13 to rotate, the boss sleeve is secured against movement, preventing inadvertent activation of the piston cylinder 16.

When the switch lever 31 is rotated clockwise from the drill mode position of FIG. 4A to the position shown in FIG. 4B, where the lever is oriented vertically, the first pin 33 is moved rearward to permit rearward movement of the switch plate 27. This simultaneously causes the clutch 19 to move rearward into engagement with the boss sleeve 13, thus allowing the rotation of the intermediate shaft 5 to be transmitted to and rotate the boss sleeve 13 now coupled to the clutch 19 as well as to the tool holder 8 via the second gear 7. Rotation of the boss sleeve 13 causes rocking of the swash bearing 14, such that the connecting arm 15 causes the piston cylinder 16 to reciprocate within the tool holder 8. This in turn causes the striker 18 to make reciprocating motion within the piston cylinder 16 and repeatedly delivers hammer blows to the impact bolt 11, which abuts the rear end of the tool bit 10. Accordingly, in this switch lever position, the power tool 1 operates in the hammer drill mode, in which hammer blows as well as rotation are transmitted to the bit 10.

It should be noted that the lock plate 35 moves rearward with the rearward slide of the clutch 19 and disengages from the projection 40 of the stopper 39, such that the lock plate 35 is permitted to rotate integrally with the boss sleeve 13 without interfering with the rotation of the boss sleeve 13.

By rotating the switch lever 31 further clockwise from the hammer drill mode position of FIG. 4B to the position shown in FIG. 5A, the first pin 33 is shifted further to the right, while maintaining the positions of the switch plate 27 and the clutch 19 and the engagement of the clutch 19 with the boss sleeve 13. However, the second pin 34 is shifted forward to disengage the second gear 7 from the clutch 19, such that the rotation of the intermediate shaft 5 is not transmitted to the second gear 7. As this causes neither the third gear 9 nor the tool holder 8 to rotate, the power tool 1 operates in the hammer mode, in which the bit 10 receives hammer blows only. In this switch lever position in particular, the second gear 7 is disengaged and free for rotation. This means that the third gear 9 and the tool holder 8 are also free for rotation, placing the hammer drill 1 in a neutral position or a neutral hammer mode in which the rotational angle of the bit 10 can be manually adjusted as desired.

By manually rotating the switch lever 31 further clockwise from the neutral hammer mode position of FIG. 5A to the rightmost position shown in FIG. 5B, the second pin 34 is shifted further forward, sliding the second gear 7 to the forward position and causing the lock claws 25 to engage the arc plate 26. Accordingly, as in the previous position, the mode of operation is a hammer mode in which the rotation of the intermediate shaft 5 is not transmitted to the second gear 7, with the bit 10 receiving hammer blows only. In this switch lever position, however, the second gear 7 is secured against rotation by the arc plate 26, thus prohibiting the rotation of the third gear 9 and the tool holder 8. Accordingly, this places the tool bit 10 in a lockup position or a lockup hammer mode in which the rotational angle of the bit 10 cannot be adjusted.

As described above, the hammer drill 1 of the first embodiment is provided with a lock mechanism operated by the slide motion of the switch plate 27 and the clutch 19 so as to prevent the rotation of the boss sleeve 13 only in the drill mode. This ensures that hammer blows are not delivered to the tool bit 10 in this operating mode, thereby enhancing the reliability of the hammer drill 1.

In particular, one advantage offered by the lock mechanism is its simplicity and the ease with which it can be constructed as the mechanism is assembled from a lock plate 35 disposed around the boss sleeve 13, a coil spring 38 that biases the lock plate 35 toward the clutch 19, and a stopper 39 secured within the housing 2 and engaged by the lock plate 35 when the lock plate slides forward upon disengagement of the clutch 19 from the boss sleeve 13.

It should be noted that the lock plate 35 need not have a disk shape as in the foregoing embodiment. If the axial dimension of the boss sleeve 13 permits, the lock plate 35 may take the form of a cylinder or sleeve fitted around the boss sleeve 13. However, the foregoing disk shape is preferred as it occupies only minimum of axial space and can be easily incorporated into existing clutch mechanisms without substantial redesigning. Additionally, the arrangement for the engagement/disengagement between the lock plate 35 and the stopper 39 is not limited to the combination of recesses and a projection as in the foregoing embodiment. Those with ordinary skill in the art will appreciate that other means, arrangements, or mechanisms, including but not limited to a combination of a pin and a hole or engagement between two sets of claws or teeth, such as the engagement between the second gear and the arc plate 26, may be equally satisfactory and achieve the same intended effect.

Embodiment 2

Another embodiment according to the present invention is described hereinafter with reference to the attached drawings, in which identical reference numerals are assigned to identical components, such as certain basic structures of the hammer drill, throughout the several views. Therefore, description of such elements is omitted.

FIG. 6 is an enlarged view of the clutch mechanism according to the second embodiment of the invention, showing a lock member, such as a lock sleeve 41, coupled to the boss sleeve 13. The lock sleeve 41 is comprised of a reduced diameter section 42 tightly fitted around the neck of the boss sleeve 13 immediately to the rear of the claws 23 and a large diameter section 43 which extends forward from the reduced diameter section 42 and into which the clutch 19 is loosely inserted. A plurality of axial grooves 44 is provided in the peripheral surface of the large diameter section 43 at regular intervals around the circumferential direction.

An element for engaging the axial groove 44, such as an engaging plate 45, is coupled to the switch plate 27. The engaging plate 45 includes a lock portion 46 that extends axially without contacting the lock sleeve 41. The engaging plate 45 further includes at the rear end of the lock portion 46 a bent tip 47 adapted to engage one of the axial grooves 44. The axial length of the lock portion 46 is set such that the bent tip 47 engages one of the axial grooves 44 only when the switch plate 27 is in the forward position, i.e., when the tool is the drill mode, and the bent tip 47 is shifted rearward from the axial groove 44, disengaging from the lock sleeve 41, when the switch plate 27 is in any of the rear positions, i.e., when the tool is any of the other modes (the hammer drill mode shown in FIG. 7B and the two hammer modes shown in FIGS. 8A and 8B).

In a hammer drill 1 thus constructed, when the drill is in the drill mode as shown in FIG. 7A, the lock sleeve 41, which is integrally rotatable with the boss sleeve 13, is prohibited from rotation by the engaging plate 45. Accordingly, the boss sleeve 13 is also prohibited from rotation by the lock sleeve 41. Even when the friction produced between the outer peripheral surface of the intermediate shaft 5 in rotation and the inner peripheral surface of the stationary boss sleeve 13 exerts a force on the boss sleeve 13 to rotate, the boss sleeve 13 is secured against movement, preventing inadvertent activation of the piston cylinder 16. Additionally, the boss sleeve 13, being disconnected from the clutch 19 in this operating mode, does not affect the rotation of the clutch 19. The lock portion 46 and the bent tip 47 of the engaging plate 45, being out of contact with the lock sleeve 41 in any mode other than the drill mode, do not interfere with the lock sleeve 41, which rotates with the boss sleeve 13.

As described above, the hammer drill according to the second embodiment incorporates a lock mechanism which also effectively prevents percussive operation in the drill mode, thus enhancing the reliability of the hammer drill.

In particular, one advantage offered by the lock mechanism is the ease with which it can be constructed from a lock sleeve 41 disposed at the forward portion of the boss sleeve 13 and integrally rotatable with the boss sleeve 13, and an engaging plate 45 adapted to engage one of the axial grooves 44 provided in the lock sleeve 41.

It should be noted that the lock member need not take the shape of a sleeve, such as the lock sleeve 41 of the second embodiment. Any lock member with a suitable configuration, including a semi-circle, an arc, and a simple plate, connected to the boss sleeve will suffice as long as it is capable of attaining the intended objectives. Moreover, the arrangement for the engagement and disengagement between the lock sleeve 41 and the engagement plate 45 is not limited to the combination of axial grooves and a bent tip as in the second embodiment. Those with ordinary skill in the art will appreciate that other means, arrangements, or mechanisms, including but not limited to a combination of a slit provided in the lock member and an appropriate element inserted rearward into the slit and a combination of a through-hole or recess and an elastic tip or piece adapted to engage and disengage from the hole, may be employed without departing from the scope of the present invention.

The foregoing first and second embodiments of the invention are described as applied to a hammer drill employing a swash bearing as a mechanism for converting rotary motion into reciprocating motion. The present invention, however, is not so limited and applicable to a tool including a crank mechanism in which the piston member and an eccentric pin of a crankshaft disposed at the rear of the tool holder are coupled at a right angle by a connecting rod. For example, a key member or a sleeve member to which the rotation of the motor is transmittable is disposed on the crankshaft in a manner that permits independent rotation of such a member. To enable the selection of the operating mode of the hammer drill, a switch member is operated to connect the key member to and disconnect the member from the crankshaft. By additionally providing a lock member that can engage and secure the crankshaft against the rotation of the crankshaft in the drill mode, the percussive operation can be effectively prevented in a manner similar to the foregoing embodiments.

Embodiment 3

Another embodiment according to the present invention is described hereinafter with reference to the attached drawings, in which as in the description of the second embodiment, identical reference numerals are assigned to identical components, such as certain basic structures of the hammer drill, throughout the several views. Therefore, description of such elements is omitted and only the clutch mechanism is described.

FIG. 9 is an enlarged view of the clutch mechanism according to the third embodiment of the present invention, showing a limiting member, such as a lock bar 48, extending from the switch plate 27. The lock bar 48 extends rearward alongside the inner housing 4 with its rear end portion 49 bent at a right angle toward the center axis of the piston cylinder 16. The bent portion 49 is configured such that its front surface L1 is located slightly forward of the rearmost position of the piston cylinder 16 (line L2 in FIG. 9) in the normal reciprocating stroke. In any operating mode (FIGS. 10–12) of the hammer drill other than the drill mode, the rearward shift of the switch plate 27 locates the bent portion 49 behind the rearmost position of the piston cylinder 16 in the stroke on the line L2, such that the bent portion 49 does not interfere with the reciprocation of the piston cylinder 16.

In a hammer drill 1 thus constructed, when the drill is in the drill mode, the friction produced between the outer peripheral surface of the intermediate shaft 5 in rotation and the inner peripheral surface of the stationary boss sleeve 13 exerts a rotational force on the boss sleeve 13, resulting in the piston cylinder 16 tending to reciprocate via the swash bearing 14 and the connecting arm. However, the piston cylinder 16 abuts the bent portion 49 of the lock bar 48, thus preventing the piston cylinder 16 from reaching the rearmost position in the stroke. This ensures that the piston cylinder 16 stops at this position without inadvertently causing a hammer blow. Even if the piston cylinder 16 is located forward of the bent portion 49 when the power tool 1 is in the drill mode, the cylinder 16 always abuts the bent portion 49, effectively preventing hammer mode operation.

As described above, according to the third embodiment, the switch plate 27 incorporates an integral lock bar 48 positioned in the range of the movement of the piston cylinder 16 (in this case the stroke of the reciprocating cylinder) for limiting the movement of the piston cylinder only in the drill mode. This prevents percussive operation in an effective manner, thus enhancing the reliability of the hammer drill. In particular, the third embodiment achieves higher reliability than the first and second embodiments as the structure of the third embodiment directly interferes with and stops the movement of the piston cylinder 16.

It should be noted that the movement limiting member may be a component other than that described and illustrated in the foregoing embodiment. Alternative structures will suffice insofar as such alternatives are positioned where they can limit the rearward movement of the piston cylinder. For example, as shown in FIG. 13, the lock bar 48 of the foregoing embodiment may be replaced with a lock bar 50 having multiple bends in the rear portion, or the lock bar 48 may be replaced with other designs, including a simple straight bar. Moreover, the structure for biasing the switch plate 27 is not limited to the foregoing, in which the switch plate 27 is biased by a coil spring 24 fitted on the intermediate shaft 5. As an alternative, as shown in FIG. 13, a first pin 51 and a second pin 52, both projecting forward, may be disposed in the inner housing 4 with a sleeve 53 on the front plate 28 fitted on the first guide pin 51. Additionally, the second guide pin 52 penetrates the rear panel 29 with a coil spring 54 fitted on the second guide pin 52 to bias the switch plate 27 in the rearward direction.

As the first and second embodiment, the third embodiment is applicable not only to a hammer drill employing a swash bearing as a mechanism for converting rotary motion into reciprocating motion but also to a tool including a crank mechanism in which the piston member and an eccentric pin of a crankshaft disposed at the rear of the tool holder are coupled at a right angle by a connecting rod. For example, if a lock member is provided on the switch member for the selection of the operating mode such that the lock member may be located in the range of the movement of the connecting rod when the tool is in the drill mode, the lock member will interfere with the reciprocation of the piston member, thus preventing inadvertent hammer blows.

Equivalents

It will thus be seen that the present invention efficiently attains the objects set forth above, among those made apparent from the preceding description. As other elements may be modified, altered, and changed without departing from the scope or spirit of the essential characteristics of the present invention, it is to be understood that the above embodiments are only an illustration and not restrictive in any sense. The scope or spirit of the present invention is limited only by the terms of the appended claims.

Having described the invention, what is claimed as new and desired to be secured by Letters Patent is:

1. A hammer drill comprising:

a bit;

a housing;

a piston member disposed rear of the bit for making reciprocating motion;

a motor capable of rotation;

an intermediate shaft capable of being rotated by the rotation of the motor transmitted thereto;

a rotation mechanism for transmitting rotation of the motor to rotate the bit;

a conversion mechanism for converting the rotation of the intermediate shaft into reciprocating motion of the piston member;

a striking mechanism including a striker interlocked with the piston member for causing the striker to deliver hammer blows to the bit;

a switch member for selectively preventing the rotation of the motor from being transmitted to the conversion mechanism, the switch member being operable from outside of the housing to select one of at least two operating modes, a drill mode, in which only the rotation of the motor is transmitted to the bit, and a hammer drill mode, in which the rotation of the motor and the hammer blows are transmitted to the bit; and a lock mechanism interlocked with the switch member such that the lock mechanism can prohibit the reciprocating motion of the piston member only in the drill mode.

2. A hammer drill in accordance with claim 1 further comprising a clutch slidably mounted on and integrally rotatable with the intermediate shaft;

wherein the conversion mechanism includes a sleeve member mounted on the intermediate shaft and capable of integral rotation with the intermediate shaft;

the switch member is adapted to slide the clutch into connection with the sleeve member; and the lock mechanism includes:

a lock plate mounted on the sleeve member between the clutch and the sleeve member, the lock plate being capable of integral rotation with the sleeve member and axial slide with respect to the sleeve member;

biasing means for biasing the lock plate toward the clutch; and a stopper secured within the housing for engaging the lock plate when the lock plate slides to the stopper upon disconnection of the clutch from the sleeve member.

3. A hammer drill in accordance with claim 2, wherein the sleeve member includes at least one claw, the lock plate has an annular shape including at least one protrusion which is provided on an inner edge thereof and which remains in engagement with the at least one claw of the sleeve member regardless of the slide position of the clutch, and the lock plate further includes at least one recess provided in an outer edge thereof and capable of engaging a projection provided on the stopper following the disconnection of the clutch from the sleeve member, thus preventing the lock plate and thus the sleeve member from rotation.

4. A hammer drill in accordance with claim 3, wherein when the clutch is slid forward and away from the sleeve member, the biasing force of the biasing means slides the lock plate forward so as to engage one of the recesses of the lock plate with the projection of the stopper while maintaining the engagement between the at least one protrusion of the lock plate and the at least one claw of the sleeve member.

5. A hammer drill in accordance with claim 2, wherein when the clutch is slid forward and away from the sleeve member, the biasing force of the biasing means slides the lock plate forward into engagement with the stopper while maintaining the engagement between the lock plate and the sleeve member.

6. A hammer drill in accordance with claim 2, wherein the biasing means is a coil spring interposed between the lock plate and the sleeve member, and the conversion mechanism further includes a swash bearing with a connecting rod coupled to the piston member and capable of imparting reciprocating motion to the piston member.

7. A hammer drill in accordance with claim 2, wherein the clutch, the lock plate, the biasing means, and the sleeve member are coaxially arranged on the intermediate shaft with the clutch located forward of the sleeve member.

8. A hammer drill in accordance with claim 2, wherein the lock plate remains in engagement with the sleeve member regardless of the slide position of the clutch;

in the drill mode, the stopper interferes with and prevents the rotation of the lock plate while engaging the lock plate; and when the clutch is slid into connection with the sleeve member by the operation of the switch member, the lock plate is slid and disengaged by the clutch from the stopper so as to allow integral rotation of the lock plate with the sleeve member.

9. A hammer drill in accordance with claim 2 further comprising a second biasing means mounted around the intermediate member for biasing the switch member toward the clutch, causing the clutch to engage the sleeve member in the hammer drill mode.

10. A hammer drill in accordance with claim 1 further comprising a clutch slidably mounted on and integrally rotatable with the intermediate shaft;

wherein the conversion mechanism includes a sleeve member mounted on the intermediate shaft and capable of integral rotation with the intermediate shaft;

the switch member is adapted to slide the clutch into connection with the sleeve member; and the lock mechanism includes a lock member provided on a portion of the sleeve member adjacent to the clutch and integrally rotatable with the sleeve member and an engaging member provided on the switch member and, in the drill mode, located in a position where the engaging member engages the lock member.

11. A hammer drill in accordance with claim 10, wherein the lock member includes a reduced diameter section mounted on a forward portion of the sleeve member and a cylindrical large diameter section provided between the reduced diameter section and the clutch and extending forward from the reduced diameter section, the large diameter section including an outer peripheral surface and a plurality of axial grooves provided in the outer peripheral surface, and the large diameter section further being configured to receive the clutch therein; and the engaging member includes an elongated portion extending rearward from the switch member along the outer peripheral surface of the large diameter section and an engaging tip provided at a rear end of the elongated portion and bent toward the lock member for engaging one of the axial grooves in the drill mode so as to prevent the rotation of the lock member.

12. A hammer drill in accordance with claim 11, wherein the switch member is slidable at least between a forward position, corresponding to the drill mode, in which the engaging tip engages one of the axial grooves and a rear position, corresponding to the hammer drill mode, in which the engaging tip is located rear of the axial grooves, thus not engaging any of the axial grooves.

13. A hammer drill in accordance with claim 11, wherein an axial length of the elongated portion is set such that the engaging tip engages one of the axial grooves of the lock member only when the switch member is in the forward position and the engaging tip is located rear of the large diameter section, when the switch member is in the rear position.

14. A hammer drill in accordance with claim 10 further comprising a second biasing means mounted around the intermediate member for biasing the switch member toward the clutch, causing the clutch to engage the sleeve member in the hammer drill mode.

15. A hammer drill in accordance with claim 1, wherein the lock mechanism is a limiting member provided integrally with the switch member and capable of being positioned within a range of the reciprocating motion of the piston member in the drill mode for interfering with the piston member and limiting the reciprocating motion of the piston member.

16. A hammer drill in accordance with claim 15, wherein the piston member has a center axis along which the piston member reciprocates between a first position and a second position rear of the first position, and the limiting member includes a forward portion extending rearward from the switch member and a rear end portion coupled to a rear end of the forward portion and bent toward the center axis of the piston member, the rear end portion being positioned forward of the second position of the piston member in the drill mode.

17. A hammer drill in accordance with claim 16, wherein the switch member is slidable at least between a forward position, corresponding to the drill mode, in which the rear end portion of the limiting member is positioned forward of the second position of the piston member, and a rear position, corresponding to the hammer drill mode, in which the rear end portion of the limiting member is positioned rear of the range of the reciprocating motion of the piston member, permitting the piston member to reciprocate between the first and second positions thereof.

18. A hammer drill in accordance with claim 16, wherein the forward portion of the limiting member extends in parallel with the center axis of the piston member and the rear end portion of the limiting member extends perpendicularly from a rear end of the forward portion.

19. A hammer drill in accordance with claim 16, wherein the forward portion of the limiting member extends in parallel with the center axis of the piston member, and the rear end portion of the limiting member extends from a rear end of the forward portion and is bent perpendicularly three times.

20. A hammer drill in accordance with claim 15 further comprising a clutch slidably mounted on and integrally rotatable with the intermediate shaft;

a pin secured within the housing and penetrating the switch member; and a second biasing means mounted around the pin between the switch member and a free end of the pin for biasing the switch member toward the clutch, causing the clutch to engage the sleeve member in the hammer drill mode.

* * * * *